US005449283A

United States Patent [19]

Herrmann

[11] Patent Number: 5,449,283

[45] Date of Patent: Sep. 12, 1995

[54] MACHINE FOR VERTICAL CASTING OF PIPES OF CONCRETE OR A SIMILAR MATERIAL IN A MOULD SYSTEM WITH A DISTRIBUTOR WHEEL

[75] Inventor: Bent Herrmann, Hjorring, Denmark

[73] Assignee: Pedershaab A/S, Denmark

[21] Appl. No.: 133,080

[22] PCT Filed: Apr. 15, 1992

[86] PCT No.: PCT/DK92/00128

§ 371 Date: Jan. 28, 1994

§ 102(e) Date: Jan. 28, 1994

[87] PCT Pub. No.: WO92/18309

PCT Pub. Date: Oct. 29, 1992

[30] Foreign Application Priority Data

Apr. 19, 1991 [DK] Denmark ..... 0713/91

[51] Int. Cl.[6] ..... B28B 21/26; B28B 21/28

[52] U.S. Cl. ..... 425/262; 425/427

[58] Field of Search ..... 425/262, 427, 432, 460

[56] References Cited

U.S. PATENT DOCUMENTS

| | | | |
|---|---|---|---|
| 1,616,816 | 2/1927 | Martin | 425/262 |
| 2,386,961 | 10/1945 | Lake | 425/262 |
| 2,404,464 | 7/1946 | Sewell | 425/262 |
| 2,520,199 | 8/1950 | Butcher | 425/262 |
| 3,141,222 | 7/1964 | Steiro | 425/262 |
| 3,276,091 | 10/1966 | Pausch | 425/262 |
| 3,358,342 | 12/1967 | Spence | 425/262 |
| 3,746,494 | 7/1973 | Gauger | 425/262 |
| 4,334,848 | 6/1982 | Gross et al. | 425/262 |
| 5,040,968 | 8/1991 | Kraiss | 425/262 |
| 5,147,196 | 9/1992 | Adly | 425/262 |

FOREIGN PATENT DOCUMENTS

| | | | |
|---|---|---|---|
| 477849 | 8/1975 | U.S.S.R. | 425/262 |
| 772872 | 10/1980 | U.S.S.R. | 425/262 |

*Primary Examiner*—James P. Mackey

*Attorney, Agent, or Firm*—Finnegan, Henderson, Farabow, Garrett & Dunner

[57] ABSTRACT

A machine serves to cast pipes of concrete or a similar material substantially vertically. The machine includes an inner mould part (2) and an outer mould part (12). These mould parts are displaced axially with respect to each other during the casting process. A vibrator is preferably provided upwardly in the inner mould part (2), and an axially journalled distributor wheel (1) is rotatably mounted on the top of the mould part (2) the distributor wheel (1) having a plurality of blades (4) for distributing the material in the ring gap between the two mould parts (2, 12). The distributor wheel (1) and its mount are constructed so stiffly that the vibrations generated by the vibrator are transmitted to the material through the blades of the wheel. This ensures, when a firm profile ring is used for the casting of the spigot end, that area of difficult access below said ring is filled completely with concrete, and that the concrete obtains the prescribed quality. It is hereby possible to cast pipes which have very narrow longitudinal tolerances and also spigot ends which fully satisfy the requirements made of shape and quality.

8 Claims, 6 Drawing Sheets

MACHINE FOR VERTICAL CASTING OF PIPES OF CONCRETE OR A SIMILAR MATERIAL IN A MOULD SYSTEM WITH A DISTRIBUTOR WHEEL

FIELD OF THE INVENTION

The invention concerns a machine for substantially vertical casting of pipes of concrete or a similar material, comprising inner and outer mould parts, respectively, which are displaced axially with respect to each other during the casting process, at least one vibrator being preferably arranged upwardly in the inner mould part, an axially journalled distributor wheel being rotatably mounted on the top of said mould part, said distributor wheel having a plurality of blades for distributing the material in the space between the two mould parts.

BACKGROUND

Casting of e.g. concrete pipes generally takes place in mould systems of the above-mentioned type by filling fresh concrete from above down into the ring gap between the vertically positioned mould parts, the concrete being then vibration compressed, while the two mould parts are displaced with respect to each other. The simultaneously rotating distributor wheel on the top of the inner mould part is to serve to distribute the concrete uniformly and evenly in the ring gap, but since the relatively dry concrete, which is normally used for such purposes, is stiff and difficult to deform in a fresh non-vibrated state, it has not been possible to distribute the concrete fully satisfactorily in the ring gap with the known distributor wheels. This problem is particularly pronounced at the upper termination of the pipe and has significantly contributed to the impossibility of casting pipes with the desired narrow length tolerances and with spigot ends which satisfy the requirements made of the quality of the concrete in any respect.

SUMMARY OF THE INVENTION

In a very widely used method the spigot end is shaped by pressing a profile ring with a specific pressure down against the upper side of the concrete in the filled mould, whereby the uppermost layer of concrete is compressed and compacted in a proportion corresponding to the applied pressure. However, the resulting compression, which finally determines the overall length of the finished pipe, may vary greatly from pipe to pipe within the same series depending upon possible differences in the composition of the concrete, the charging accuracy, and the duration of the pressure, and also because of the failure of the above-mentioned conventional distributor wheels to distribute the concrete evenly and uniformly in the uppermost concrete layer of the ring gap.

It is attempted to control these factors, all of which have a generally adverse impact on the longitudinal tolerance of the pipe, in specially developed casting machines with such a great accuracy as is feasible, and in this manner it has been possible to narrow the longitudinal tolerance of the cast pipes to a certain degree with generally the same basic method. However, the achieved tolerances are still not completely satisfactory, and to this should be added that the casting machines in question have an extremely complicated structure, and that it is therefore difficult permanently to keep control over the casting process.

In another method the pipe is cast in one operation with a firm profile ring ensuring that the longitudinal tolerances are carefully observed. However, the relatively inaccessible area below this firm profile ring cannot readily be filled completely with concrete by means of the conventional distributor wheels, just as the concrete is not always compressed sufficiently with certainty, and these factors can lead to casting of pipes with spigot ends having a deficient shape and/or a too poor conrete quality.

The object of the invention is to provide a machine of the type mentioned in the opening paragraph, which, with much narrower longitudinal tolerances than known before, can repeatedly cast concrete pipes with spigot ends which have the desired full shape and a concrete quality which satisfies the made requirements with certainty.

This is achieved according to the invention by constructing the distributor wheel and its mount so stiffly that the vibrations generated by the vibrator can be transmitted to the material through the blades of the wheel without significant damping. This entails that the fresh concrete is vibrated as soon as it meets the distributor wheel and will therefore be brought into a liquid and easily deformable state already at this time, enabling the distributor wheel to distribute the concrete evenly and uniformly in the ring gap between the two mould parts with certainty, the concrete being simultaneously subjected to a direct vibration compression which ensures that the concrete obtains a satisfactory quality at the upper termination or spigot end on the pipe as well.

When the space between the blades of the wheel is arranged so as to be open upwardly, downwardly and peripherally, and when the top of the inner mould part is simultaneously conical and the lower edges of the blades follow this cone at a small distance, an expedient flow passage for the dropping fresh concrete will be provided directly through the actual wheel.

The blades of the wheel may moreover be screw-shaped with a thread extending in the opposite direction of the rotary direction of the wheel. This entails that during passage of the wheel the concrete will not only be vibrated, but also subjected to a downwardly and outwardly directed pressure which effectively forces the concrete out into the ring gap and simultaneously applies a predetermined compression pressure to the concrete.

Because of the above-mentioned advantageous properties of the distributor wheel the wheel is particularly suitable for the casting method comprising using a firm profile ring for shaping the spigot end of the pipe. In this case the distributor wheel ensures that the area below the profile ring is filled completely with concrete, and that the concrete is duly compressed. The pipes can hereby constantly be cast with spigot ends which always have the correct full shape and concrete quality, while the longitudinal tolerances of the pipes are carefully observed.

When the spigot end is cast with a firm profile ring, the inner mould part continues to move upwardly with respect to the outer mould part, whereby the distributor wheel is pushed up through the opening of the profile ring. The distributor wheel is therefore formed with a diameter which is slightly smaller than the diameter of this opening. During the continued rise the inner mould part, too, will be pushed up through the opening of the profile ring, and it is important that the mould part fills the opening as well as possible considering the vibration amplitude, such that it can cut off the spigot end of the pipe from the excessive amount of concrete in a well-defined manner. This cut-off is promoted by forming the transition between the conical portion and the cylindrical portion of the inner mould part as a sharp edge.

To collect the excess amount of concrete formed in the cutting-off of the spigot end, according to the invention, the profile ring may upwardly have a hopper-shaped expansion which also serves as a filling hopper. The concrete residue collected in this hopper is vibration-compressed by the distributor wheel like the concrete at the spigot end, and it will therefore have such a stable state that it will hang as a ring downwardly in the hopper when the inner mould part is pulled down through the opening of the profile ring during the demoulding operation. However, the concrete residue will be loosened by the vibrations and/or the dropping fresh concrete in the next working cycle, so that the concrete residue will be incorporated as a component in the next pipe.

It has been found that the best results are obtained when the casting process is terminated in that the distributor wheel rises up through the opening with a gradually decreasing speed of rotation and/or gradual vibration intensity.

BRIEF DESCRIPTION OF THE DRAWINGS

The invention is explained more fully by the following description of an embodiment, which just serves as an example, with reference to the drawing, in which.

DESCRIPTION OF PREFERRED EMBODIMENTS

Figure 1:
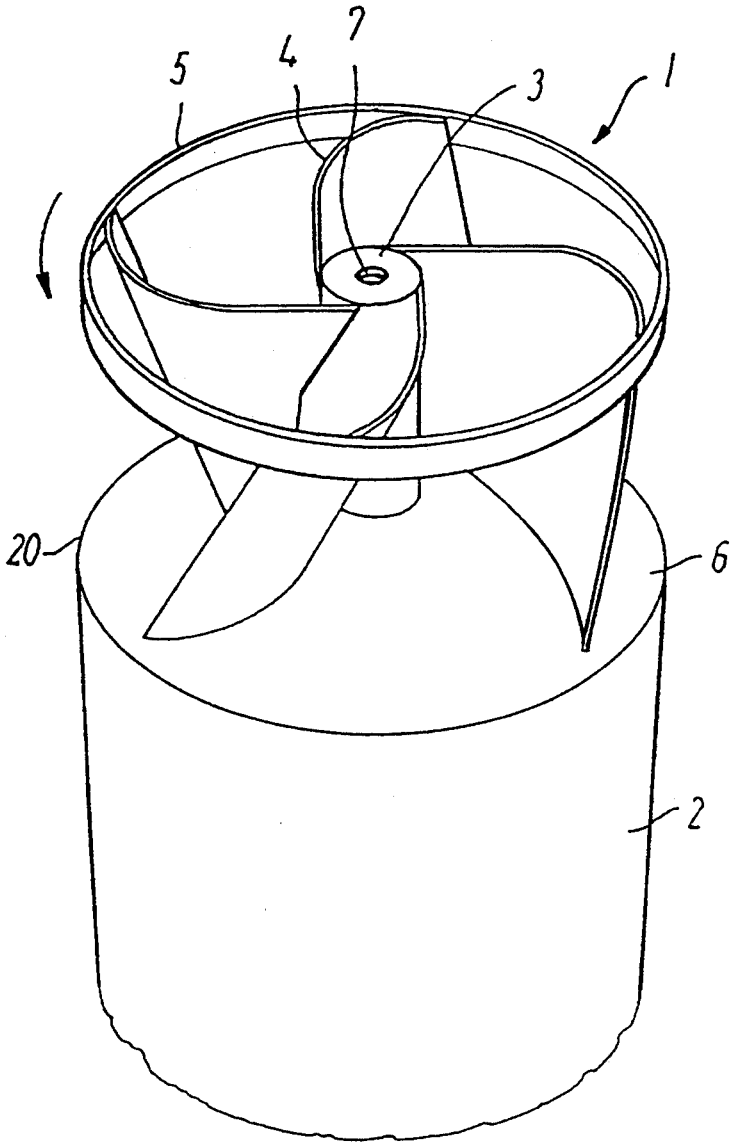
FIG. 1 is a perspective view of a distributor wheel according to the invention mounted on the top of an inner mould part.

FIG. 1 shows a distributor wheel 1 which is rotatably mounted on an inner mould part 2 by means of a hub 3, from which four blades 4 radiate, said blades being upwardly connected with a stiffening ring 5 to stabilize the structure. The inner mould part 2 upwardly terminates in an upwardly converging cone 6, and a journal 7 extends upwardly from the center of the cone to mount the wheel. The journal 7 is journalled in a bearing (not shown), which is positioned inside the inner mould part 2, and can be caused to rotate by means of a power transmission device (not shown). A vibrator (not shown) for vibrating the concrete is moreover provided inside the top of the inner mould part. The structure of the hub 3 and the journal 7 as well as the mounting of it may be arranged in any other expedient manner, but it is of decisive importance in all cases that the structure is built so stiff and solid that the vibrations are transmitted practically undamped from the inner mould part 2 to the distributor wheel 1. The blades themselves, which may e.g. be made of sheet iron with a suitable thickness, are moreover separately shaped as a helicoid directed rearwardly with respect to the direction of rotation.

It now appears from FIGS. 2–6 how the distributor wheel shown in FIG. 1 is used for casting of a concrete pipe 8 with a socket 9, a shank 10 and a spigot end 11. In addition to the inner mould part 2 with the distributor wheel 1, the overall mould system also comprises an outer mould part 12, which stands on a bottom ring 13, which simultaneously serves as a pallet for the cast pipe 8. The bottom ring 13 in turn rests on a table 15, associated with the casting machine, via vibration damping rubber buffers 14. A profile ring 16 is secured upwardly in the outer mould part 12 to shape the spigot end 11 of the pipe. Upwardly the profile ring 16 merges into a hopper-shaped expansion 17, which serves as a filling hopper for the concrete fed by means of a belt conveyor 18 in the shown case.

As will appear, the outer mould part 12 is stationary during the casting process, while the inner mould part 2 moves from below up into the outer mould part, and, simultaneously, the distributor wheel 1 rotates in the direction indicated by the arrow, and the vibrator (not shown) emits the vibrations indicated by the symbol 19. The fresh concrete drops from the belt conveyor 18 via the filling hopper 17 down through the upwardly open spaces between the rearwardly directed screw-shaped blades 4 of the distributor wheel, which then press the concrete downwardly and outwardly in a manner such that the concrete is distributed evenly and uniformly in the ring gap between the two mould parts 2, 12, the downwardly directed portion of the movement of the concrete being facilitated because of the downwardly inclined face on the cone 6 of the inner mould part 2. Since the distributor wheel 1 is so stiffly journalled on the inner mould part 2 that its vibrations simultaneously cause the distributor wheel to vibrate, the concrete is subjected to vibrations already during the transport through the distributor wheel, which change the originally relatively stiff and unworkable state of the fresh concrete to a liquid state which ensures the even and uniform distribution of the concrete in the ring gap. Simultaneously, the blades 4 apply to the concrete a predetermined static pressure which begins the vibration compression of the concrete already in the actual wheel.

Figure 2:
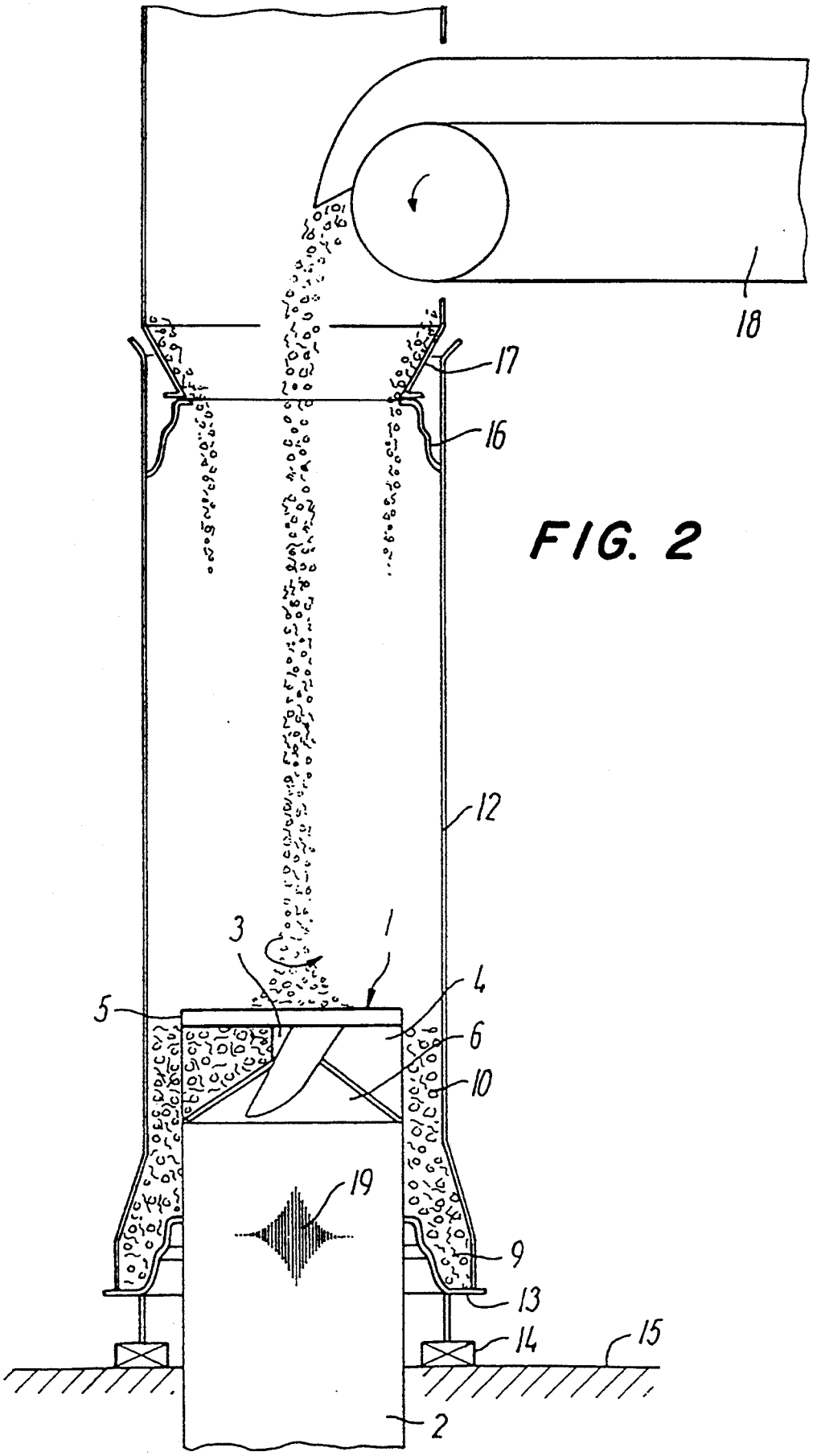
FIGS. 2–6 are sectional views at various stages in the casting of a concrete pipe by means of the distributor wheel shown in FIG. 1.
Figure 3:
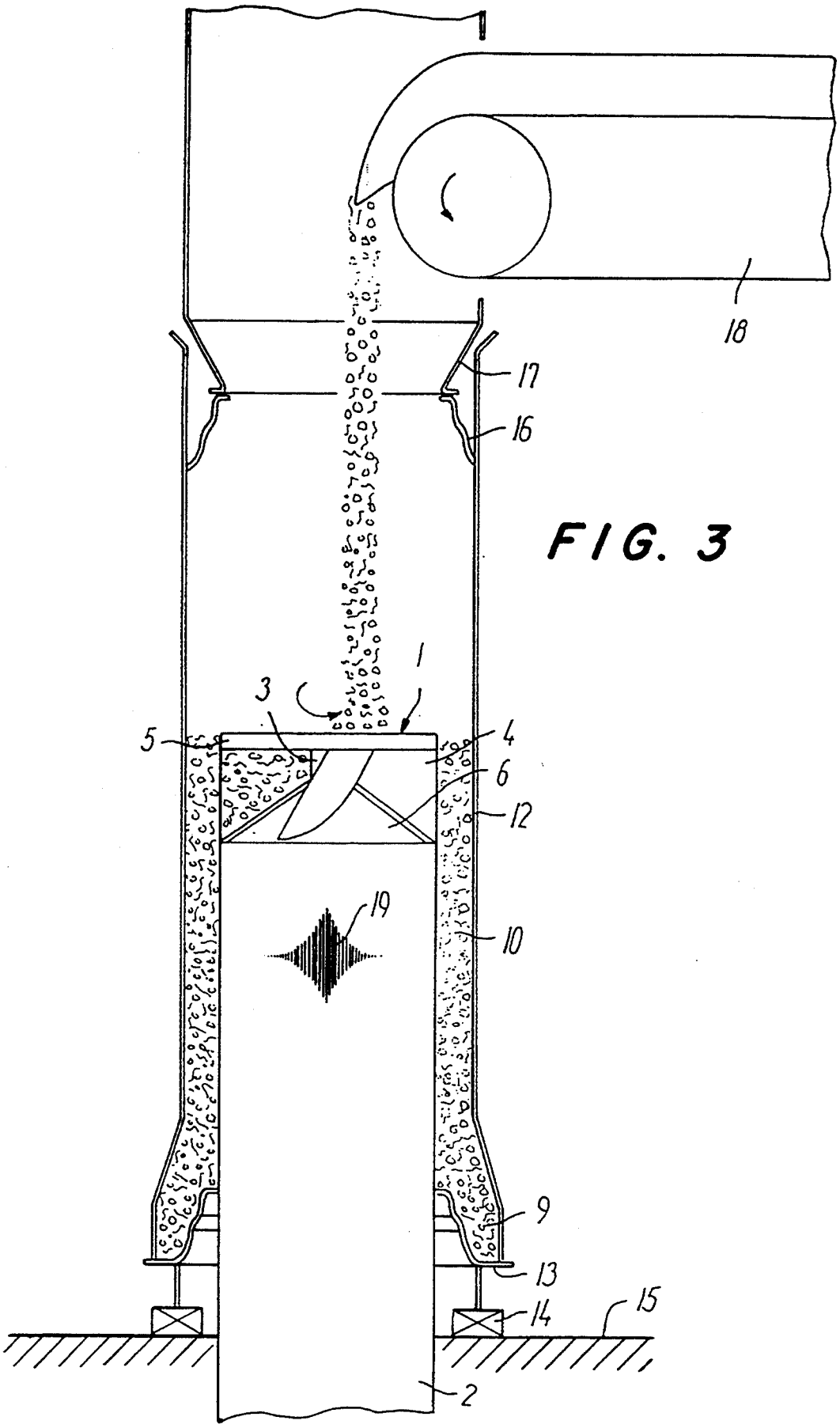
Figure 4:
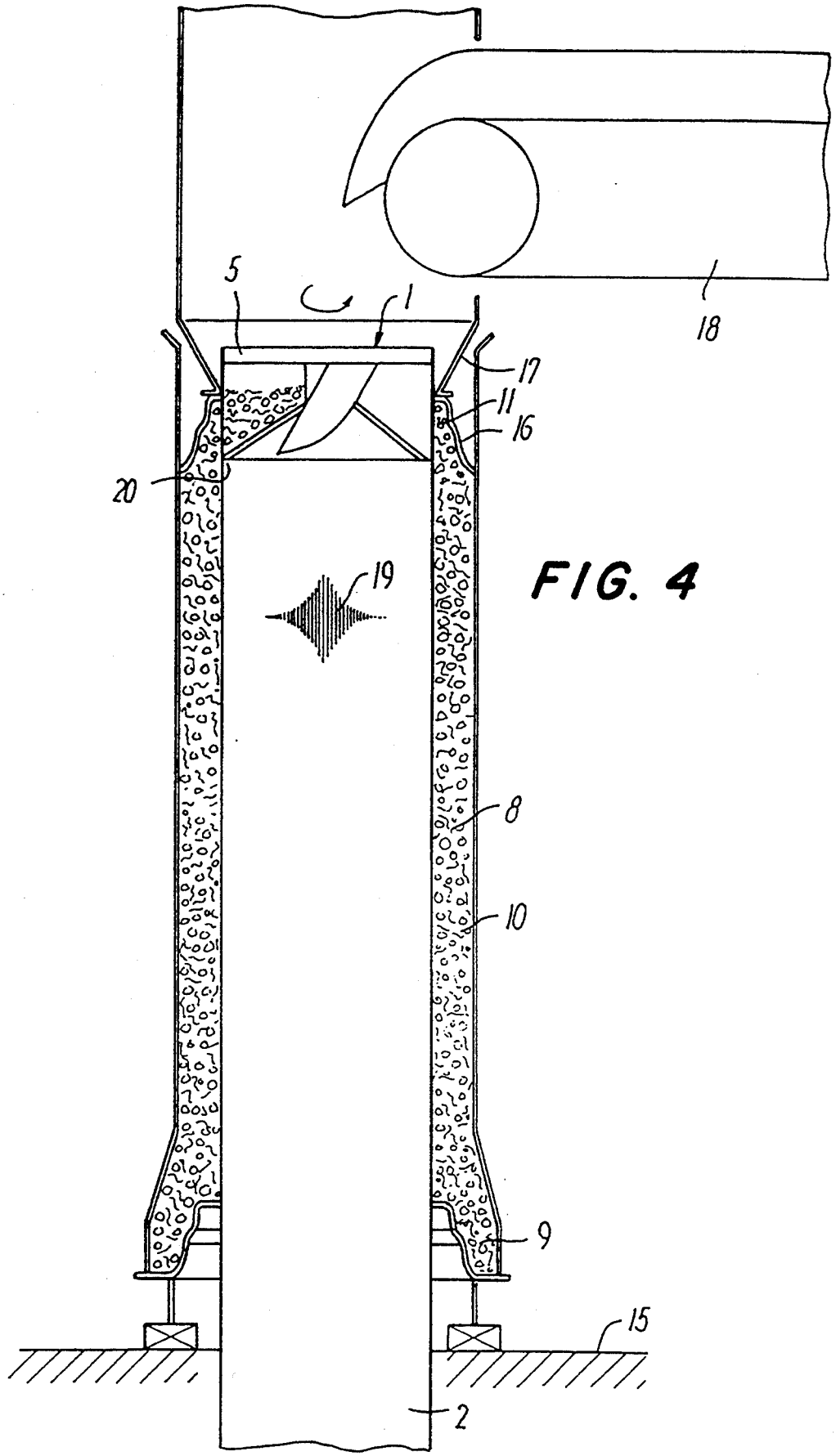
Figure 5:
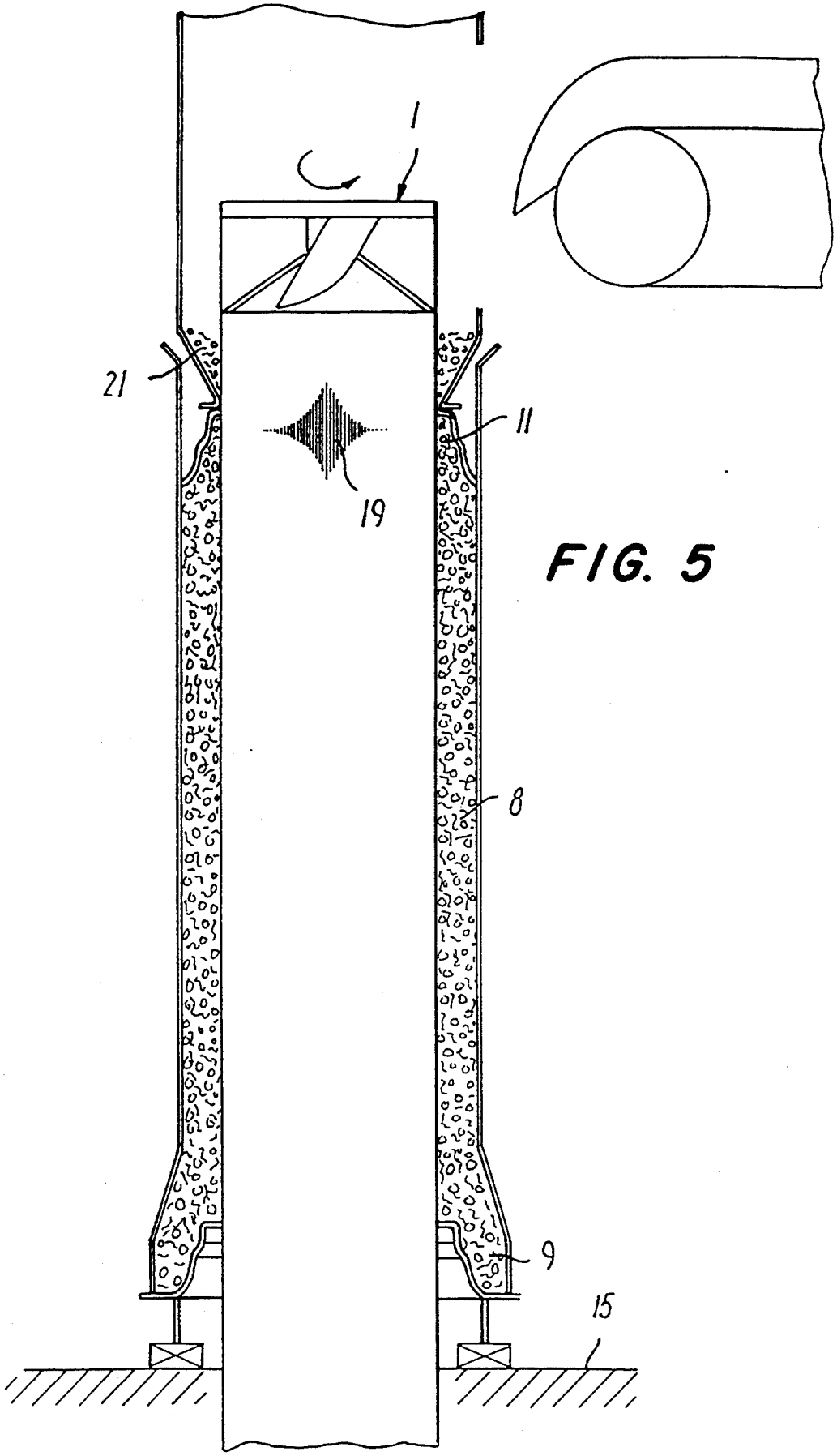

In FIG. 2 the casting of the socket 9 of the pipe has just been completed, and casting of the shank 10 of the pipe has been initiated. During the continued casting concrete is successively filled from the belt conveyor 18, while the inner mould part 2 continues its upward movement in the outer mould part 12. FIG. 3 shows a later stage in the casting of the shank 10 of the pipe, and in FIG. 4 the shank has been finished, while casting of the spigot end 11 is in its final phase where the distributor wheel 1 is on its way up through the opening of the profile ring 16. Even though the distributor wheel, as shown, fills this opening almost completely, it has constantly been possible for fresh concrete to pass through the wheel during casting of the spigot end for replenishing the area of difficult access below the profile ring. Because of the impact of the screw-shaped blades on the concrete this area will be filled completely with concrete, which is simultaneously vibration compressed, as described previously. This process ensures that the spigot ends of the cast pipes always have the intended full shape, and that the concrete of which the spigot ends are formed, satisfies the quality requirements made. Since the process takes place with a firm profile ring, it is simultaneously possible to cast the pipes with very narrow longitudinal tolerances.

For the distributor wheel 1 to pass up through the opening of the profile ring 16, it must have an outside diameter which is slightly smaller than this opening. The same applies to the inner mould part 2, which subsequently moves up through the opening (FIG. 5), and which, with a sharp edge 20, cuts off the finished spigot end 11 from the excess concrete material 21. However, the clearance between the inner mould part and the opening of the profile ring must be as small as possible and preferably just slightly greater than the greatest vibration amplitude to ensure that the spigot end will be cut off sharply and thereby be terminated with a precise shape.

Figure 6:
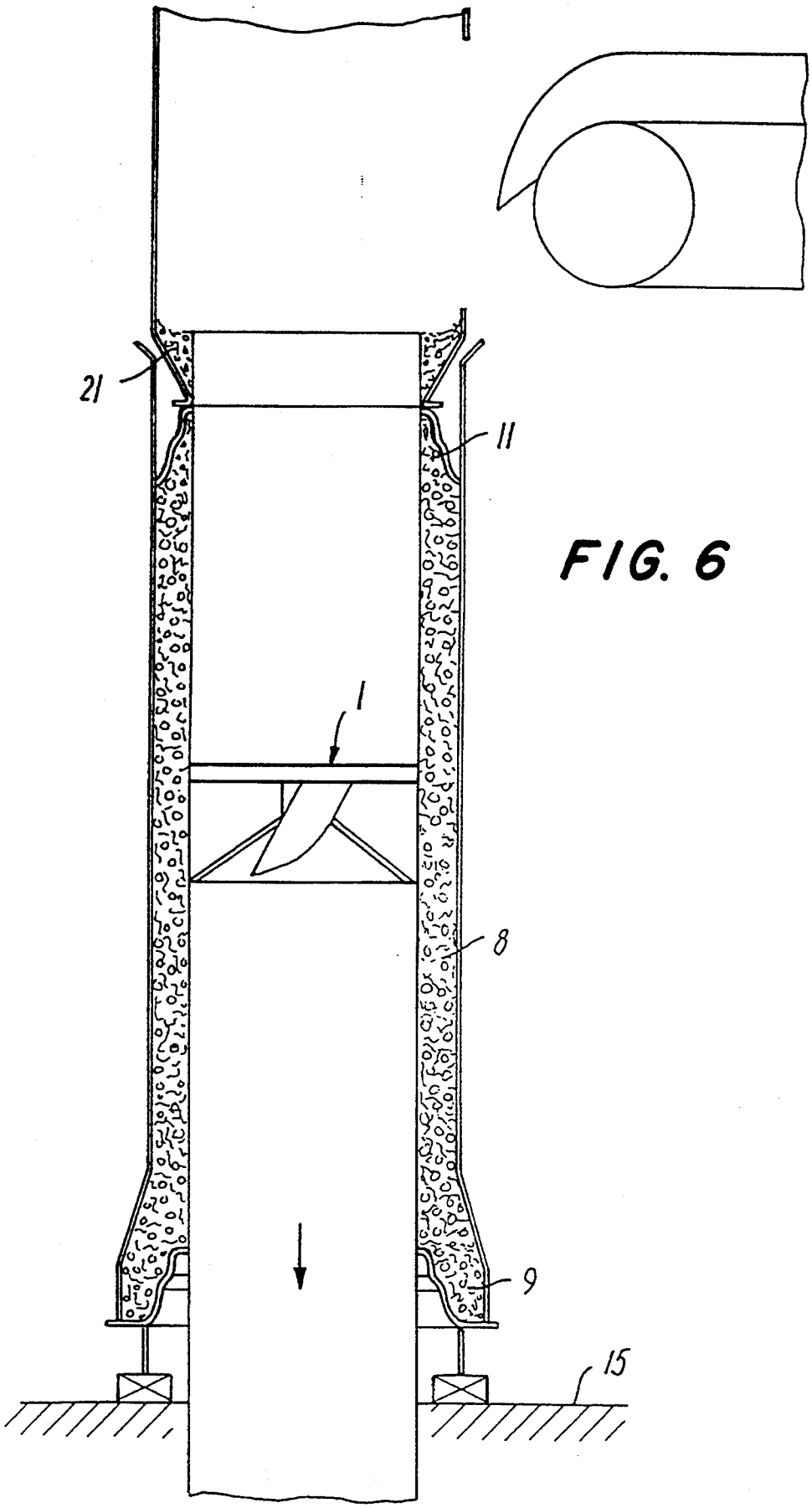

The excess concrete material 21, which has now been cut off from the finished pipe, is collected downwardly in the filling hopper 17, where the excess concrete 21 is vibration compressed by the distributor wheel 1 in the same manner as the concrete in the pipe 8. The excess concrete 21 will therefore have a sufficiently great stability of shape to remain in the filling hopper 17 when the inner mould part 2 is pulled out of the finished pipe, as shown in FIG. 6. The concrete ring 21 will be loosened later in the next working cycle by the vibrations during the next working cycle, and, as shown in FIG. 2, drop down and mix with the fresh concrete from the belt conveyor 18. Demoulding of the cast pipe is completed in the shown case by pulling the outer mould part 12 upwardly in a conventional manner until it is free of the pipe 8, which is now ready for being driven out to a curing site, standing on the bottom ring 13.

Less concrete is consumed for casting the spigot end per unit of length than for casting the shank. Accordingly, the speed of rotation of the distributor wheel and/or the vibration intensity is gradually reduced during the passage of the distributor wheel through the opening of the profile ring. This also ensures a very gentle termination of the vibration compression process, which finally just takes place with the lowermost tip of the blades at the sharp edge 20 of the inner mould part as far as the spigot end is concerned.

To fully achieve the above-mentioned advantageous effects of the distributor wheel, this must be constructed with well-balanced dimensions. It has been found that this is achieved best when the height of the distributor wheel is between 0.1–1.0, preferably between 0.3–0.7 and in particular between 0.4–0.6 times the diameter of the inner mould part. This wheel will advantageously be capable of rotating with a speed of between 100 and 250 rotations per minute during casting of the shank of the pipe. This speed of rotation is then gradually reduced to about 30 rotations per minute in the casting of the spigot end. The vibrations take place with a frequency of between 50 and 250 Hz in the casting of the shank, the frequency being reduced to the lower end of this range in the casting of the spigot end.

Although embodiments of the machine according to the invention for production of cylindrical pipes have been described above and shown in the drawing, other embodiments of the machine are readily conceivable within the scope of the invention, and such other embodiments may e.g. be adapted to cast pipes which are four-sided or six-sided exteriorly. Correspondingly, for the casting there may conceivably be used other materials, which are suitable for casting by means of vibration compression, than concrete e.g. the material described in the Danish Patent Application 1175/89 "A method of making acid-proof sulphur concrete pipes".

What is claimed is:

1. A machine for the substantially vertical casting of pipes of concrete, which comprises:

an outer mould part;

an inner mould part axially displaceable within the outer mould part and radially spaced from the outer mould part during casting to form a ring gap between the mould parts, the inner mould part having an upper end portion terminating in an upwardly converging cone;

an axially journalled distributor wheel rotatably mounted atop the inner mould part, the distributor wheel having a plurality of radially extending blades with lower edges spaced from and following an upper surface of the cone, the blades having a helicoid shape directed rearwardly with respect to the rotational direction of the wheel, so that during the casting, as the concrete is supplied downwardly into the outer mould part and the inner mould part is displaced axially upwardly in the outer mould part, rotation of the wheel causes the blades to press concrete downwardly and outwardly along the upper surface of the cone and into the ring gap; and at least one vibrator in an upper portion of the inner mould part for vibrating the inner mould part, the distributor wheel being mounted to the inner mould part such that vibration of the inner mould part causes the simultaneously vibration of the distributor wheel and the blades so as to transmit vibrations to concrete passing through the distributor wheel.

2. The machine according to claim 1, further including a stiffening ring connected to upper portions of the blades.

3. The machine according to claim 2, wherein a transition between the cone and a cylindrical upper portion of the inner mould part is formed by a sharp edge.

4. The machine according to claim 1, wherein the distributor wheel has a height and the inner mould part has a diameter, said height being from 0.1 to 1.0 times the diameter of the inner mould part.

5. The machine according to claim 1, further including an upwardly converging profile ring, having an opening therein and firmly connected with the outer mould part or an axially upwardly and downwardly displaceable part of the machine for forming a spigot end of the pipe, and wherein the wheel passes through the profile ring during casting and has an outside diameter which corresponds to or is slightly smaller than the opening of the profile ring.

6. The machine according to claim 5, further including an upwardly diverging filling hopper above the profile ring.

7. The machine according to claim 5, wherein the distributor wheel has a variable speed of rotation.

8. The machine according to claim 5, wherein the vibrator has a variable vibration intensity.

* * * * *